US008132642B2

(12) United States Patent
Takashima

(10) Patent No.: US 8,132,642 B2
(45) Date of Patent: Mar. 13, 2012

(54) SPEAKER SYSTEM

(75) Inventor: Mitsuru Takashima, Tokyo (JP)

(73) Assignee: M. I. Laboratories Corporation, Tokyo (JP)

( * ) Notice: Subject to any disclaimer, the term of this patent is extended or adjusted under 35 U.S.C. 154(b) by 0 days.

(21) Appl. No.: 12/680,850

(22) PCT Filed: Sep. 12, 2008

(86) PCT No.: PCT/JP2008/066554

§ 371 (c)(1),
(2), (4) Date: Mar. 30, 2010

(87) PCT Pub. No.: WO2009/044618

PCT Pub. Date: Apr. 9, 2009

(65) Prior Publication Data

US 2010/0212996 A1 Aug. 26, 2010

(30) Foreign Application Priority Data

Oct. 2, 2007 (JP) ..... 2007-258845

(51) Int. Cl.

| | |
|---|---|
| ***A47B 81/06*** | (2006.01) |
| ***G10K 11/22*** | (2006.01) |
| ***H04R 5/02*** | (2006.01) |
| *G10K 11/00* | (2006.01) |
| *G10K 11/18* | (2006.01) |
| *H04R 1/02* | (2006.01) |

(52) U.S. Cl. ..... 181/199; 181/196; 181/155; 381/160; 381/388; 381/301; 381/333; 381/338

(58) Field of Classification Search ..... 181/199, 181/156, 148, 152, 196, 155; 381/349, 160, 381/352, 388, 301, 306, 333, 338, 389
See application file for complete search history.

(56) References Cited

U.S. PATENT DOCUMENTS 4,085,289 A * 4/1978 Schmideler ..... 381/86

(Continued)

FOREIGN PATENT DOCUMENTS

JP 62076395 A * 4/1987

(Continued)

*Primary Examiner* — Edgardo San Martin
(74) *Attorney, Agent, or Firm* — Oblon, Spivak, McClelland, Maier & Neustadt, L.L.P.

(57) ABSTRACT

Normally a speaker is used by attaching to a sealed or semi-sealed cabinet so that vibration generated at the front and the back of a diaphragm does not mutually interfere. Therefore, a certain depth and a volume are necessary, and in a limited location such as a front panel of a device, there is a case that it cannot be attached to the most suitable position for a listener. As a means to solve that, a method that a speaker sound at a distant position is led to a front panel by a waveguide is practically used. However, still it has limitations in depth and attaching position, and good results cannot be obtained also in efficiency.

A speaker is attached so that a sound generated at the front of the speaker attached to a cabinet is led to a plane such as a front panel of a device by a waveguide, and the opening surface of the waveguide is almost perpendicular to the plane. Since a good sound field is generated on the opposite side to the plane, on a horizontal surface to the opening surface of the waveguide, a high efficiency speaker system having no limitation in the attaching position of a speaker can be obtained.

9 Claims, 9 Drawing Sheets

U.S. PATENT DOCUMENTS

| | | | | | |
|---|---|---|---|---|---|
| 4,593,784 | A | * | 6/1986 | Flanders | 181/144 |
| 4,646,349 | A | * | 2/1987 | Puls | 381/306 |
| 5,005,201 | A | * | 4/1991 | Rumreich et al. | 381/306 |
| 5,036,946 | A | * | 8/1991 | Yoshino | 181/156 |
| 5,170,435 | A | * | 12/1992 | Rosen et al. | 381/86 |
| 5,187,333 | A | * | 2/1993 | Adair | 181/152 |
| 5,193,118 | A | * | 3/1993 | Latham-Brown et al. | 381/86 |
| 5,218,175 | A | * | 6/1993 | Scarlata | 181/141 |
| 5,287,412 | A | * | 2/1994 | Etzel et al. | 381/86 |
| 5,361,380 | A | * | 11/1994 | You et al. | 381/349 |
| 5,524,062 | A | * | 6/1996 | Oh | 381/338 |
| 5,604,337 | A | * | 2/1997 | Sugimoto et al. | 181/152 |
| 5,646,381 | A | * | 7/1997 | Boyte, Jr. | 181/141 |
| 5,675,131 | A | * | 10/1997 | Saito et al. | 181/152 |
| 5,734,728 | A | * | 3/1998 | Meissner | 381/89 |
| 5,749,433 | A | * | 5/1998 | Jackson | 181/156 |
| 5,898,137 | A | | 4/1999 | Saito | |
| 5,943,430 | A | * | 8/1999 | Saitoh | 381/160 |
| 6,141,428 | A | * | 10/2000 | Narus | 381/338 |
| 6,343,132 | B1 | * | 1/2002 | Fukuhara et al. | 381/339 |
| 6,868,937 | B2 | * | 3/2005 | Cass | 181/192 |
| 7,010,138 | B1 | * | 3/2006 | Harris et al. | 381/337 |
| 7,218,747 | B2 | * | 5/2007 | Huffman | 381/345 |
| 7,280,665 | B2 | * | 10/2007 | Tamura et al. | 381/333 |
| 7,463,746 | B2 | * | 12/2008 | Caron et al. | 381/345 |
| 7,508,952 | B2 | * | 3/2009 | Hofmann et al. | 381/348 |
| 7,556,122 | B2 | * | 7/2009 | Moore | 181/156 |
| 7,652,724 | B2 | * | 1/2010 | Fukano | 348/836 |
| 7,796,772 | B2 | * | 9/2010 | Takahashi et al. | 381/333 |
| 2002/0085731 | A1 | | 7/2002 | Aylward | |
| 2006/0198545 | A1 | * | 9/2006 | Che et al. | 381/388 |
| 2007/0030993 | A1 | * | 2/2007 | Yun | 381/388 |
| 2007/0154055 | A1 | | 7/2007 | Nichols et al. | |
| 2008/0101646 | A1 | * | 5/2008 | Holmi | 381/389 |

FOREIGN PATENT DOCUMENTS

| | | |
|---|---|---|
| JP | 4 10495 | 1/1992 |
| JP | 4 325338 | 11/1992 |
| JP | 8 214234 | 8/1996 |
| JP | 9 289698 | 11/1997 |
| JP | 2001 145186 | 5/2001 |
| JP | 2001 218289 | 8/2001 |
| JP | 2002 300686 | 10/2002 |

* cited by examiner a CHANGE OF SOUND PRESSURE BY INCLINATION ANGLE IN HORIZONTAL DIRECTION FROM ON AXIS OF OPENING SURFACE b CHANGE OF SOUND PRESSURE BY INCLINATION ANGLE IN FORWARD DIRECTION FROM ON AXIS OF OPENING SURFACE

SPEAKER SYSTEM

TECHNICAL FIELD

The present invention relates to a speaker system or a device having a speaker system. Further, more particularly, the present invention relates to a speaker system in that a waveguide is attached to a speaker, and the opening surface of the waveguide is attached to a plane so as to be almost perpendicular to the plane, and a device having that.

BACKGROUND ART

Since a speaker generates sound waves by the vibration of diaphragm, the phases are shifted 180 degree between a vibration generated in front of the diaphragm and a vibration generated at the back. Therefore, in order to obtain good frequency characteristics and efficiency, it is necessary to avoid that the vibration generated at the back does not interfere with the vibration generated in front. As a fundamental structure, a sealed space or an almost sealed space is needed at the back.

Moreover, in a device in that the area to attach a speaker cannot be sufficiently secured as a front panel of a television receiving set, a sealed or a semi-sealed space is secured by placing the main body of a speaker in the back space of a cabinet of a television receiving set. And a technique to lead sound waves generated in front of a diaphragm to the front panel of the television receiving set by a waveguide is taken.

For example, in the Patent Publication No. 3449571, in FIG. 5, an example that a speaker is set in the back space of a cabinet of a television receiving set, and sound is led to the front panel of the television receiving set by a waveguide has been introduced.

Moreover, in FIG. 6 in the same patent, an example that a speaker is attached to a back cabinet (sealed box) in the device of FIG. 5 been introduced.

Moreover, in FIGS. 1 to 4 in the same patent, a television receiving set in which a sound at the back of a diaphragm of a speaker is radiated diagonally forward by a reflecting member, and avoiding the interference between a sound in front of the diaphragm and the sound at the back has been introduced.

Patent Document 1: Patent Publication No. 3449571

DISCLOSURE OF INVENTION

Problem to be Solved by the Invention

However, the present invention relates to a speaker system contrived to lead a speaker sound by a waveguide and a device having it, in such system, the following problems are caused.

a. The opening of a waveguide has to be provided at a position that a listener facing the device feels to be most natural as a sound source, toward the listener.

b. It has limitations in a speaker attaching position and the position of the opening section of the waveguide, because the opening surface of the waveguide and a diaphragm have to be placed so as to be almost in parallel.

c. Applying to a device with thin depth is difficult. More particularly, applying to a thin type television using an LCD or the like is difficult.

d. A reflective phenomenon of sound waves (tube resonance) is generated from the opening surface (the end part) of the waveguide toward into the tube, and frequency characteristics are disturbed.

Means for Solving the Problem

In the present invention, a speaker is put in a sealed or semi-sealed cabinet, and a speaker sound is led from the opening of the speaker in the cabinet to the front of a device in a plate or a plane form by a waveguide. And one side of the opening surface of the waveguide is attached to abut the plate or the plane of the front surface of the device. Thereby, a speaker system that can give a feeling as if there is an actual sound source at the position to a listener is proposed to solve the aforementioned problems.

Effect of the Invention

A speaker system according to the present invention does not need depth, and also in the case of fixed to a device emitting sounds forward, it can avoid having limitation in the attaching position and the attaching area of a speaker in designing. Further, it becomes unnecessary to provide the opening of a speaker on the front surface of a device. Therefore, the degree of freedom in downsizing and a design of the device is remarkably improved. More particularly, by practically using to a thin-type device, suitable results can be obtained.

An example of practically using the present invention to a television receiving set

[FIG. 2]

Figure 1:
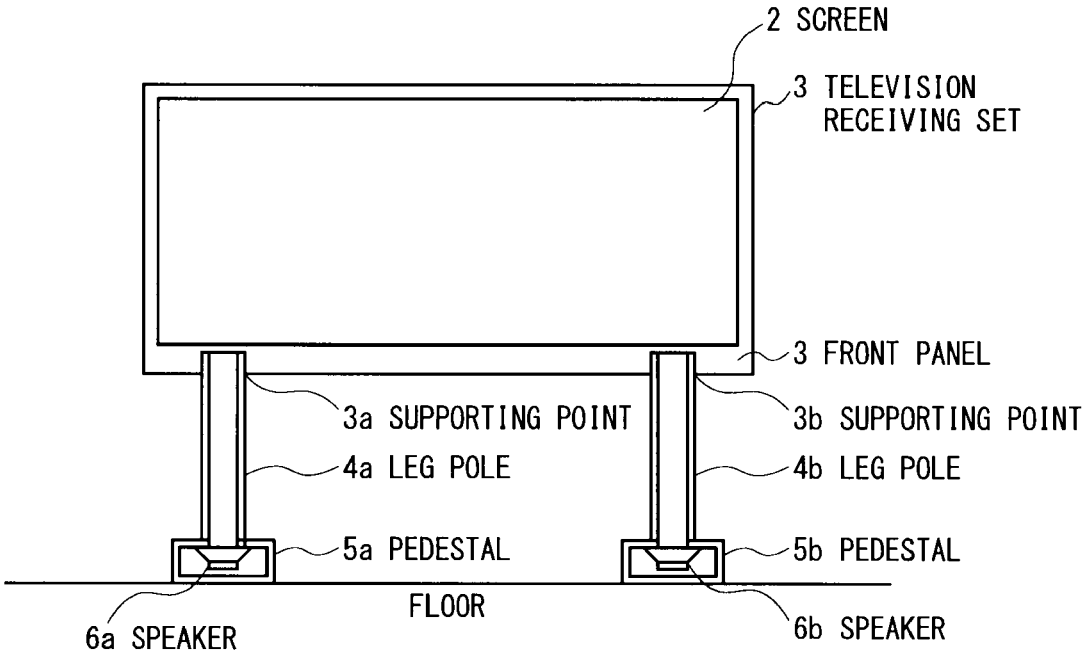
[FIG. 1]

Partially magnified perspective views of the embodiment of FIG. 1

[FIG. 3]

An embodiment of applying the present invention to sound system of automobile

[FIG. 4]

An embodiment of applying the present invention to game equipment

[FIG. 5]

Views explaining the fundamental concept of the present invention

[FIG. 6]

A view showing air flow resistance element

[FIG. 7]

Figure 5:
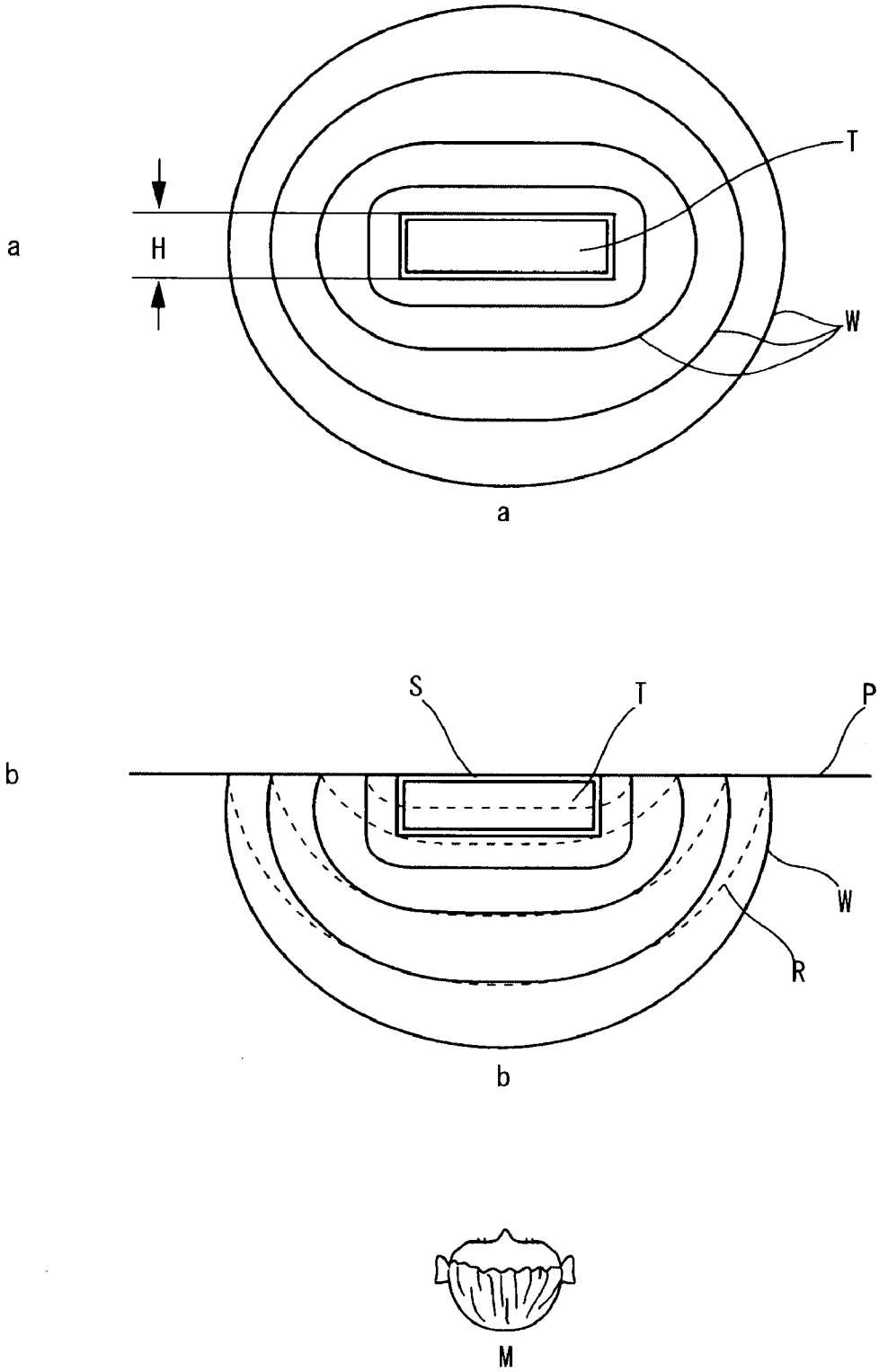

Graphs explaining the frequency characteristics of speaker having the principles shown in FIG. 5

[FIG. 8]

A perspective view of the speaker having the principles shown in FIG. 5

[FIG. 9]

Figure 8:
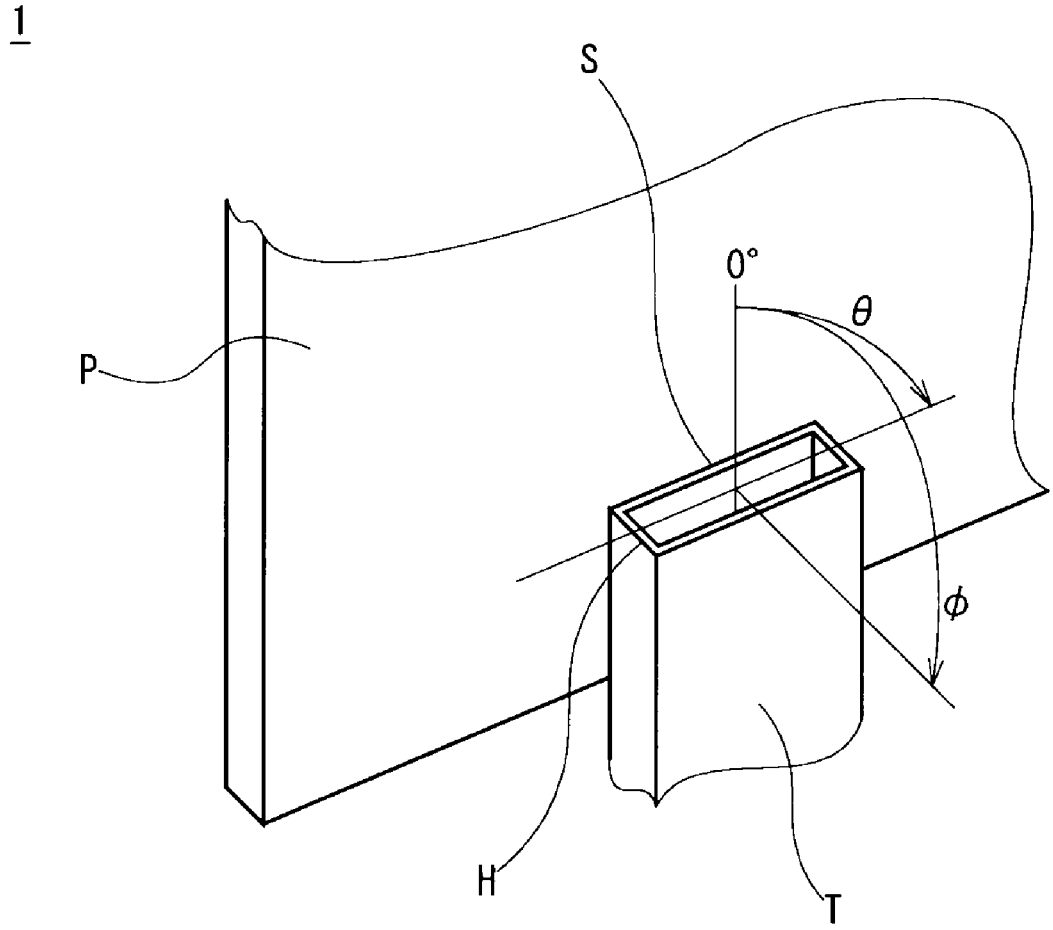

Graphs representing the frequency characteristics of the speaker shown in FIG. 8 on a surface parallel to plane and surface perpendicular to the plane

EXPLANATION OF REFERENCE NUMERALS

1—main body of television receiving set; 2—screen; 3—front panel; 4—leg pole; 5—base; 6—speaker; 31—driver's seat; 32—steering wheel; 33—door; 34—door glass; 35—speaker; 36—waveguide

BEST MODE FOR CARRYING OUT THE INVENTION

FIGS. 5*a* and 5*b* are typical views for explaining the fundamental concept of the present invention. Referring to FIG. 5*a*, "T" designates a waveguide of which the section is rectangular, and FIG. 5*a* is a view of the opening section from the top surface. There is a speaker (not shown) at the back of the waveguide T, and the opening of the speaker is covered with the opposite opening of the waveguide. A speaker sound is led by the waveguide T, and is radiated at the opening section. On the same plane as the opening, radiated sound waves are diffused around as ripples as shown by solid lines W. Next, as shown in FIG. 5*b*, if one side S of the sides of a rectangle forming the opening of the waveguide T is tightly adhered to a plane P, sound waves W ought to be diffused to the plane P side are blocked by the plane P, are reflected to the opposite side to the plane P, and reflected waves represented by dotted lines R are generated. Then, sound waves by that two waves W and R are multiplied are generated on the opposite side of the side S abutting the plane P of the waveguide T. Therefore, a listener M facing the plane P can feel as if there is a true sound source near the position that the plane and the opening section of the waveguide abut on the plane P (hereinafter, it is simply referred to as a "sound source").

If the phases of the direct wave W that is directly transmitted to the listener M side from the opening section of the waveguide and the reflected wave R transmitted by reflecting to the plane P are shifted half of the wavelength, cancellation by interference occurs. Therefore, a thickness H of the waveguide and the shape should be carefully studied according to a required reproducing frequency band. For example, when in reproducing 7 KHz, if the speed of sound is assumed to be 340 m/sec, one wavelength becomes approximately 5 cm, and cancellation occurs when the thickness H is approximately 2.5 cm. Accordingly, in a general device, the thickness H is desirable to be 2.5 cm or less.

By the way, waveguides enable to efficiently lead the sound of a speaker sound source to an opening end. However, since sound impedance extremely varies between at the tube section and the opening end, a reflective phenomenon of sound waves is generated at the opening end. It is known that therefore, forward waves and reflected (backward) waves are superimposed, and increase of proper sound called tube resonance occurs and the frequency characteristic is remarkably deteriorated.

Figure 6:
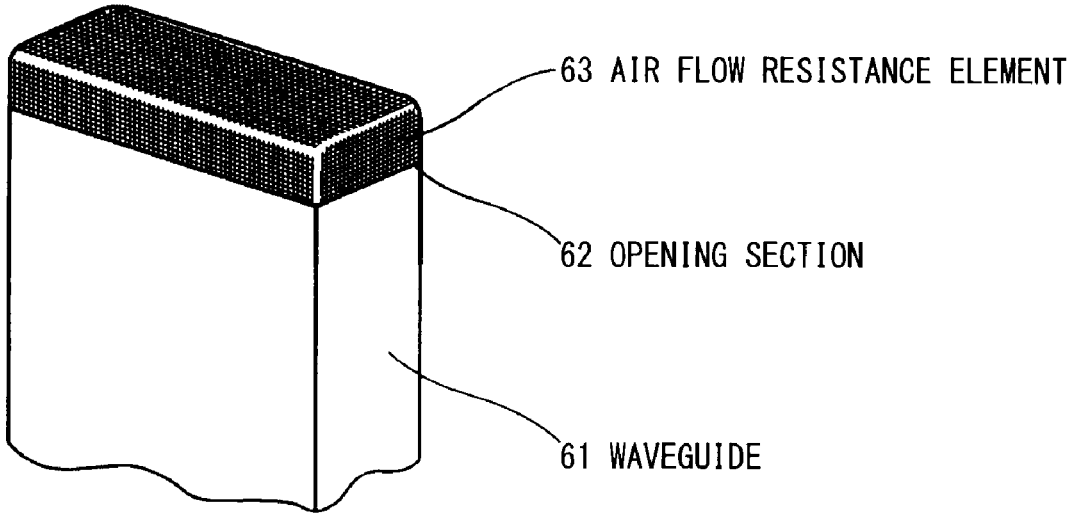

FIG. 6 shows means for preventing the tube resonance.

Referring to FIG. 6, a reference numeral 61 designates a waveguide. Its opening section 62 is covered as closed with an air flow resistance element 63 made of a cloth in thickness of approximately 1.0 mm having air passing characteristic. By this air flow resistance element 63, a sudden change in sound impedance in the opening section of the waveguide is lessened, and tube resonance can be reduced. As a form of the air flow resistance element 63, a plane form, a hat form or the like is considered. It is always unnecessary to cover all the surface of the opening section 62. For example, the form may be a hunchbacked form in that the side is opened.

Not only to reduce tube resonance, the air flow resistance element 63 operates to prevent dirt, dust or the like from coming in from the opening section of the waveguide.

Figure 7:
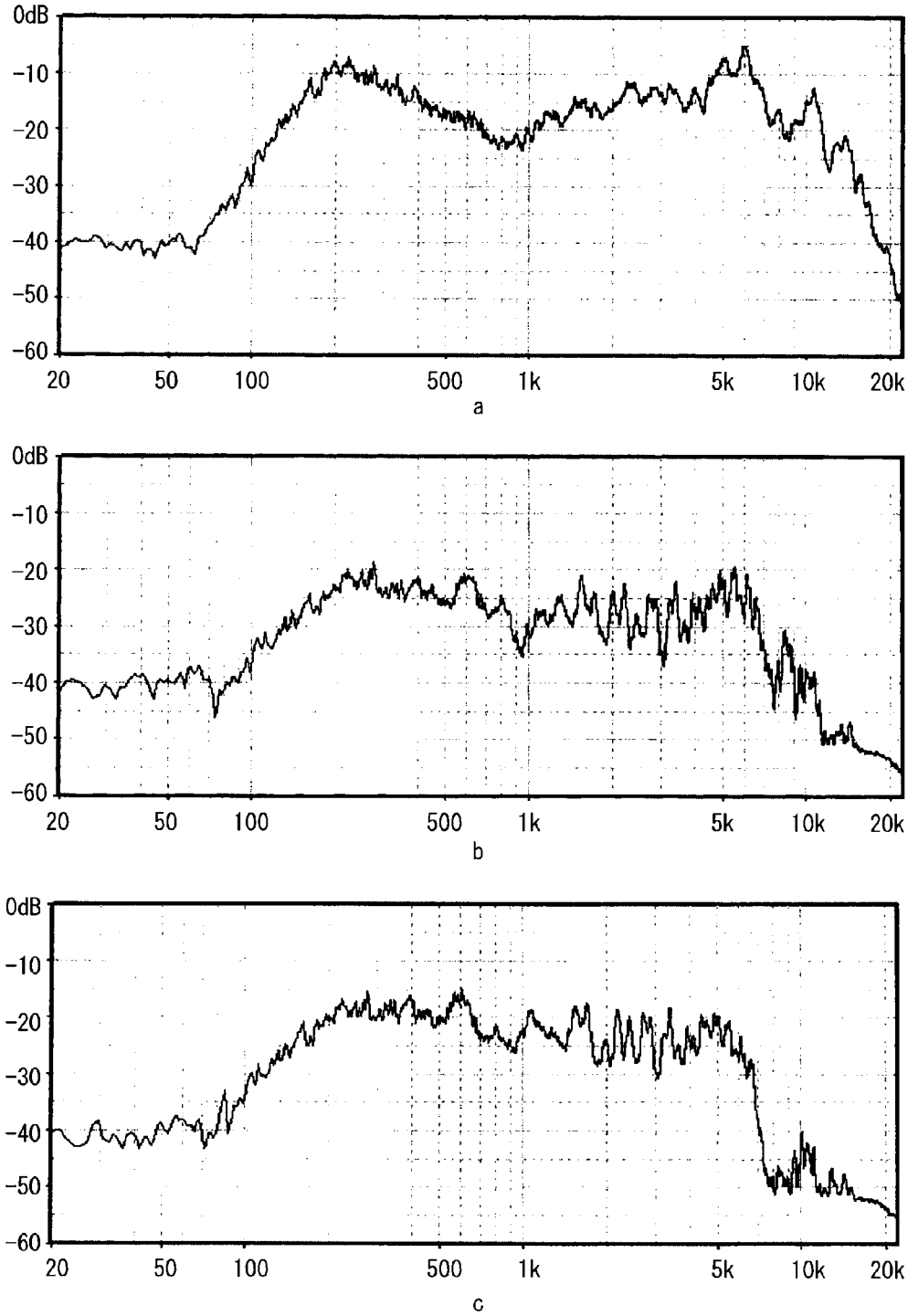

FIGS. 7*a*, 7*b* and 7*c* are graphs at the time when the frequency characteristic was measured for explaining the operation of a speaker having the principles shown in FIG. 5. In the graphs, the vertical axis represents output by decibel [dB], and the horizontal axis represents frequency by hertz [Hz].

FIG. 7*a* is a graph at the time when the frequency characteristic of a sound outputted by the speaker was measured without waveguide at a distance of 15 cm on a speaker axis. That is, it is the original sound of the speaker.

FIG. 7*b* is a graph at the time when a waveguide of 80 cm in length was attached to this speaker, and the frequency characteristic was measured at a distance of 15 cm from the center of the opening on the same plane as the opening of the waveguide.

FIG. 7*c* is a graph at the time when on contacting one side S of the opening of the waveguide to the plane P, the frequency characteristic was measured at a distance of 15 cm from the center of the opening on the same plane as the opening of the waveguide.

Note that, also in the cases of FIG. 7*b* and FIG. 7*c*, the measurement was done in the state where the aforementioned air flow resistance element 63 was attached to the opening section of the waveguide.

In the output shown in the graph of FIG. 7*b*, the output dropped 10-20 dB than the original sound in FIG. 7*a* in the all frequency band. It is found that attenuation at high frequency over around 7 KHz is remarkable, more particularly.

On the other hand, in the output shown in the graph of FIG. 7*c*, although the attenuation at over 7 KHz cannot be avoided similarly to the case of FIG. 7*b*, it is found that in other band, efficiency of approximately 5 dB in average is improved than the case of FIG. 7*b*. Furthermore, it is shown that in the all frequency band, variation of output peculiar to tube resonance was not generated.

This experiment result shows that if contacting one side forming the surface of the opening section of a waveguide to a plane so that the opening surface is almost perpendicular to the plane, increase of sound occurs in a right-angled direction to the plane by reflection by the plane, and the frequency characteristic covers a sound range required in general audio equipment. That is, the listener M who faces the plane from a horizontal direction to the surface formed by the opening can receive sufficient sound pressure enough to feel as if there is a sound source near the opening surface.

Of course, composite sound of the sound directly diffused from the opening of the waveguide and the sound reflected by the plane is diffused to all the direction except for the plane side. Therefore, we inspected about distribution of the sounds diffused to each direction in the model shown in FIG. 5*b*. FIG. 8 is a perspective view three-dimensionally representing the model shown in FIG. 5*b*. In FIG. 8, the same reference numeral is added to the same part in FIG. 5. On the opening of the waveguide T, the length of the side S contacted to the plane P is 6 cm, and the thickness H is 1.5 cm. And the plane P is a panel made of engineering plastic of 40 cm in length, 25 cm in width and 1 mm in thickness.

By using the device shown in FIG. 8, by assuming a vertical direction to the opening surface of the waveguide to be 0 degree, sound pressure at each frequency of 2 KHz, 4 KHz, 6 KHz was measured at plural points along a parallel surface to the plane P (shown by an angle $\theta$), and plural points along a vertical surface to the plane P (shown by an angle $\phi$).

Figure 9:
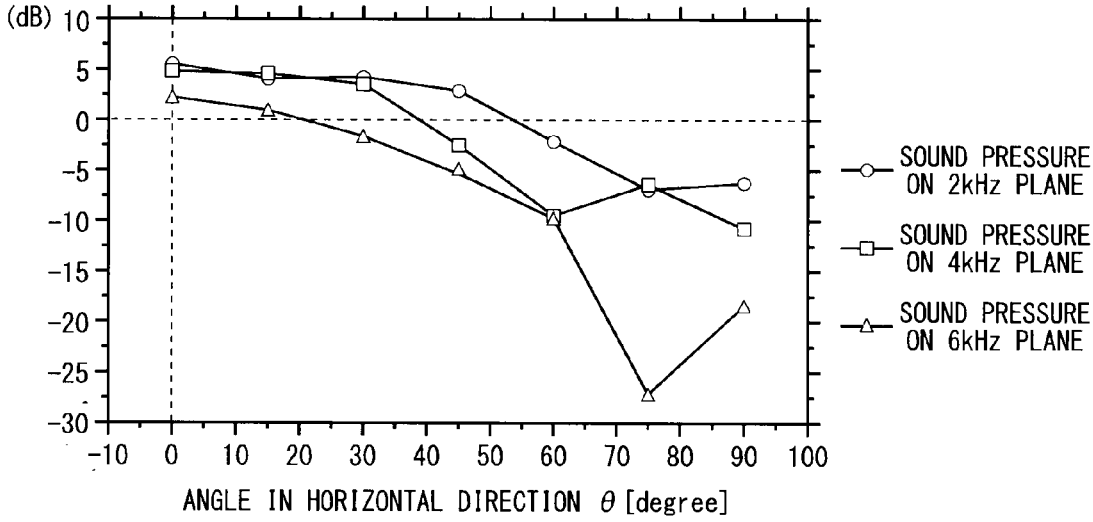
Figure 9:
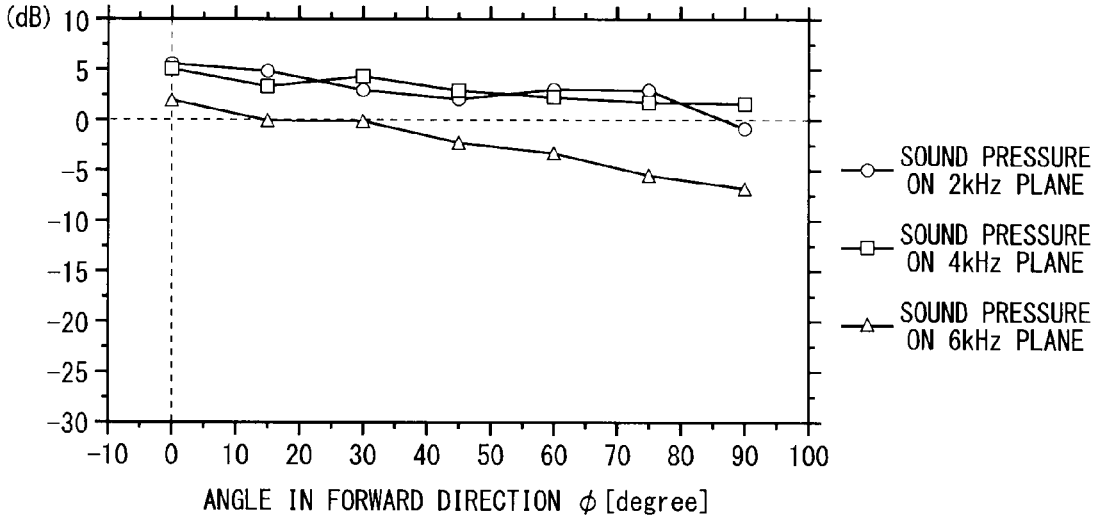

FIG. 9*a* is a graph at the time when it was measured about the angle $\theta$ on a parallel plane to the plane P, and FIG. 9*b* is a graph at the time when it was measured about the angle $\phi$ on a vertical plane to the plane. In both of the graphs, the horizontal axis represents angle, and the vertical axis represents sound pressure by decibel [dB]. Note that, for comparison, a sound pressure at a point just above 15 cm from the opening of the waveguide that was not attached to the plane was set to 0 dB.

From FIG. 9*a*, it is proved that smooth attenuation is shown from just above the waveguide (0 degree) to an angle approximately 60 degree (−10 dB) in a parallel direction to the plane by the presence of the plane.

Also from FIG. 9*b*, it is proved to show that up to approximately 75 degree in the forward direction, it attenuates smoothly while keeping the relationship between strength and weakness of each frequency.

In any rotations, plus values were observed from 0 degree to 30 degree. And it is shown that by providing the plane P, efficiency of the output is superior to the point just above the opening of the waveguide not having the plane P.

An actual sound field is a plane not only a horizontal plane and a vertical plane but also including a plane between them, and a complicated sound field will be formed according to a distance and an angle from a sound source, a frequency or the like. However, practically, in the case where a waveguide is set from a floor toward the ceiling, since a listener M listens to a sound facing the plane P at a position as that the listener M somewhat looks down the opening surface of the waveguide, to form a sound field toward the direction is most significant. And, from the experiment results shown in FIGS. 7*a*, 7*b*, and 7*c* and the experiment results shown in FIGS. 9*a* and 9*b*, it is found that the listener M can catch a sound of which the sound source is the opening section of the waveguide, and that has sufficient output, frequency characteristic and directivity.

Moreover, more particularly, from the measurement result shown in FIG. 9*b*, it is found that in the case where a waveguide is set from a floor toward the ceiling, the listener M can listen to a better sound having well-balanced frequency components by listening from a position in somewhat upper direction (forward angle $\phi$=75 degree or less) than a position on the same horizontal plane as the opening surface of the waveguide (forward angle $\phi$=90 degree). Therefore, as an attaching position when in attaching a waveguide to the plane of a device, it is good even if it is fully lower than the expected height of the ears of the listener M. Similarly, it is found that in the case where the opening surface of the waveguide is apart from the position of the ears of the listener M upward, downward, rightward and leftward, it may be inclined so that the inclination of the opening surface of the waveguide to the position of the ears is over 15 degree.

Embodiment 1

Hereinafter, embodiments of the present invention will be described with reference to drawings. Note that, in the embodiments 1 to 3, the aforementioned air flow resistance element 63 existing at the opening end of the waveguide is omitted to be shown in the drawings to simplify.

FIG. 1 is an example of the case where the present invention is practiced to a thin-type television receiving set. It is a view of the television receiving set from the front. Specially, the part of the leg poles 4*a* and 4*b* and the pedestals 5*a* and 5*b* that will be described later are represented by sections so as to know the structure. Referring to FIG. 1, a reference numeral 1 designates a main body of a television receiving set, and a reference numeral 2 designates the screen. The main body of the television receiving set 1 is supported by two leg poles 4*a* and 4*b* attached to supporting points 3*a* and 3*b* on the lower frame of a front panel 3. The leg poles 4*a* and 4*b* are formed to be hollow, and also function as waveguides of sound. The bottoms of the leg poles 4*a* and 4*b* are connected to the pedestals 5*a* and 5*b*.

The pedestals 5*a* and 5*b* are hollow box forms, and are also function as speaker boxes. Speakers 6*a* and 6*b* are attached upwardly inside the pedestals 5*a* and 5*b*. The fronts of diaphragms of the speakers 6*a* and 6*b* are openings, and the sections of the bottom sections of the leg poles 4*a* and 4*b* completely cover the speaker openings. For instance, in the case where the speaker openings are larger than the top sections of the leg poles 4*a* and 4*b*, the leg poles 4*a* and 4*b* are formed to be downwardly wider. Accordingly, sound in the fronts of the diaphragms of the speakers 6*a* and 6*b* are collected and led upwardly by the leg poles 4*a* and 4*b* also functioning as waveguides.

Figure 2:
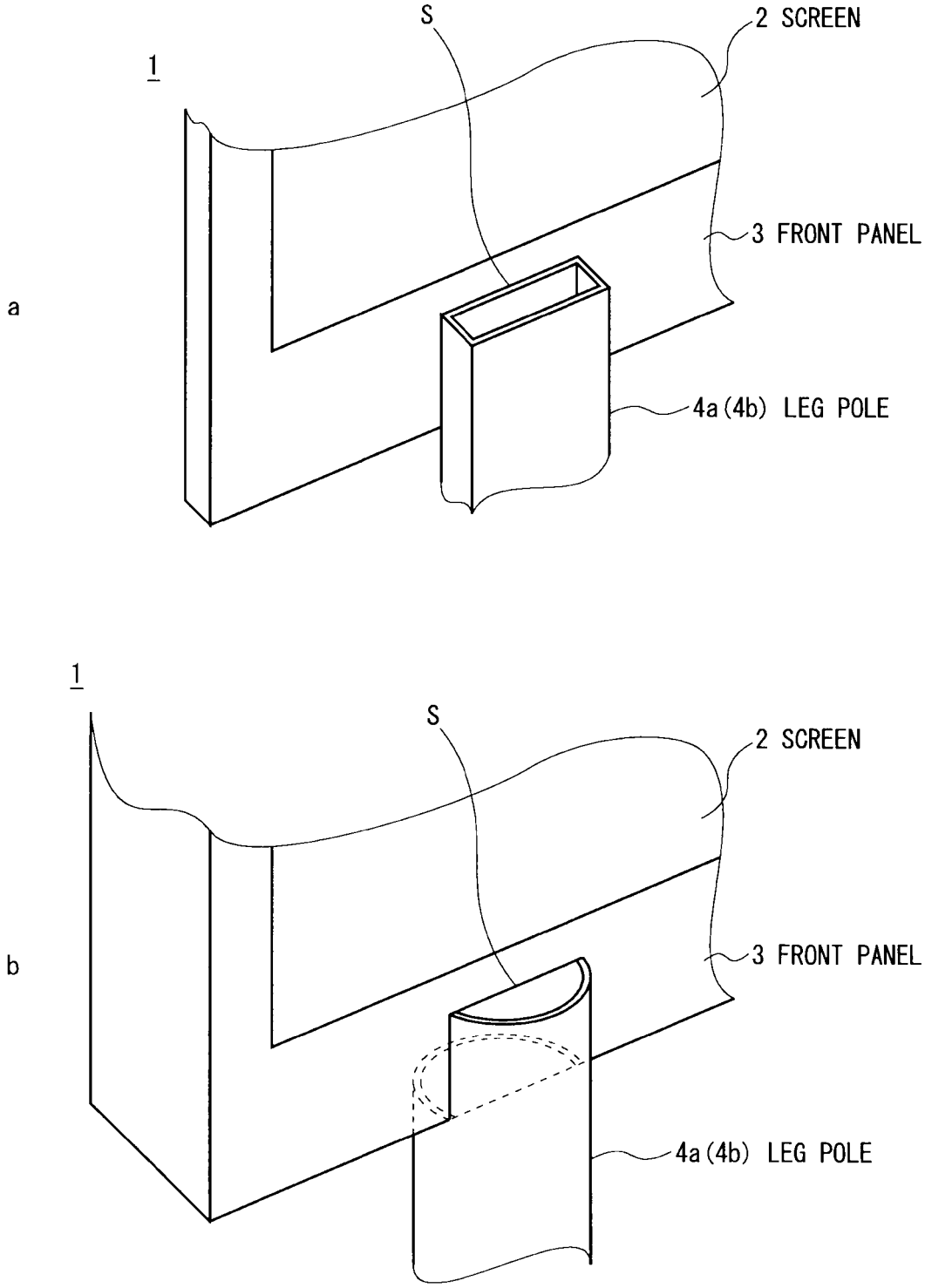

FIG. 2 are perspective views that represent by magnifying one of near the supporting points 3*a* and 3*b* in that the leg poles 4*a* and 4*b* are attached to the main body of the television receiving set 1 referring to FIG. 1. The same reference numerals are added to common parts to FIG. 1. FIG. 2*a* represents the case where the sections of the leg poles 4*a* and 4*b* are rectangular, and FIG. 2*b* represents the case where the sections are circular.

In the example of FIG. 2*a* that the section is rectangular, a side S of the leg poles 4*a* and 4*b* that abuts the panel 3 is attached to the panel 3 of the main body of the television receiving set 1 by gluing, welding, screwing, bolting or the like. When it cannot withstand the load of the television receiving set only by the leg poles 4*a* and 4*b*, or when it cannot balance, legs only for support may be provided other than it. Of course, a measure to increase the intensity of the leg poles 4*a* and 4*b* is taken depending on necessity. When the openings of the speakers 6*a* and 6*b* are circular or ellipsoidal, also the section forms of the bottom sections of the leg poles 4*a* and 4*b* are adjusted to it.

In the example of FIG. 2*b*, the leg poles 4*a* and 4*b* are formed in a cylindrical form, the circular section is vertically cut on a plane parallel to the surface of the panel 3, and the latter half is cut off. The section of the cut part is covered with the bottom surface of the television receiving set 1 and the panel 3. The parts between the parts of the leg poles 4*a* and 4*b* and the television receiving set 1 are fixed by means of gluing, welding, engaging or the like. The parts not cut of the leg poles 4*a* and 4*b* remain as hollow semicircular sections, and keep the function as waveguides. Note that, in this case, the parts of the leg poles 4*a* and 4*b* cut off are notched and covered with the bottom surface of the television receiving set are always unnecessary to be hollow. It is important that the bottom openings cover the speaker openings.

In the embodiment of FIGS. 2*a* and 2*b*, the sides S forming the straight lines of the openings of the leg poles 4*a* and 4*b* almost tightly adhere to the plane of the panel 3 or the screen 2, and the opening surface is almost rectangular to the plane of the panel 3 or the screen 2. If a sound is emitted from the speakers 6*a* and 6*b* in this state, a listener who is in front of the panel 3 or the screen 2 can feel as if there is a true sound source there on the basis of the principle explained based on FIG. 8.

Note that, in this embodiment, it has dealt with that the leg poles 4*a* and 4*b* have the form supporting the television receiving set from lower. However, it may be formed to be hanged from the upper (the ceiling), and speakers may be attached on their bases.

Embodiment 2

Figure 3:
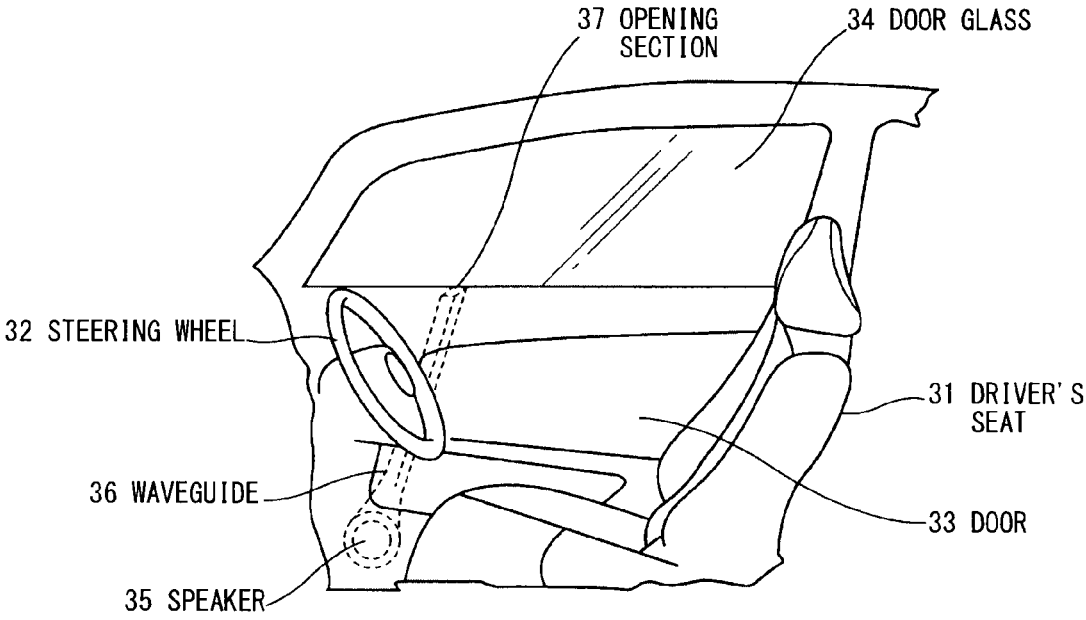

FIG. 3 is an embodiment when a speaker system according to the present invention is applied to an audio system for automobile. FIG. 3 is a side view when the driver's seat is looked from the passenger's side. A reference numeral 31 designates the driver's seat, a reference numeral 32 designates a steering eel, a reference numeral 33 designates a door, and a reference numeral 34 designates a door glass. A reference numeral 35 designates a speaker. However, usually it is built into the interior space of the door or into a wall near foot, and only a speaker grill is exposed on the surface. Therefore, a sound emitted from the speaker 35 is usually emitted near the driver's foot, in addition, toward horizontal directions.

In the embodiment 2 shown in FIG. 3, a speaker cabinet (not shown) is built into the lower space of the door 33, and a waveguide 36 is attached so as to cover the front of the diaphragm of the speaker 35. And the waveguide 36 is passed so as to pass through the inside of the door, and is attached so that an opening surface 37 of the end is almost perpendicular to the surface of the door glass 34. Thereby, a sound generated in the horizontal direction to the opening surface of the waveguide and a reflected sound on the surface of the door glass 34 are mixed near the opening section of the waveguide 37, and a sound source is generated at the position. Thus, a driver can listen to music or the like almost in the height of the ears, and acoustic effects can be remarkably improved.

Embodiment 3

Figure 4:
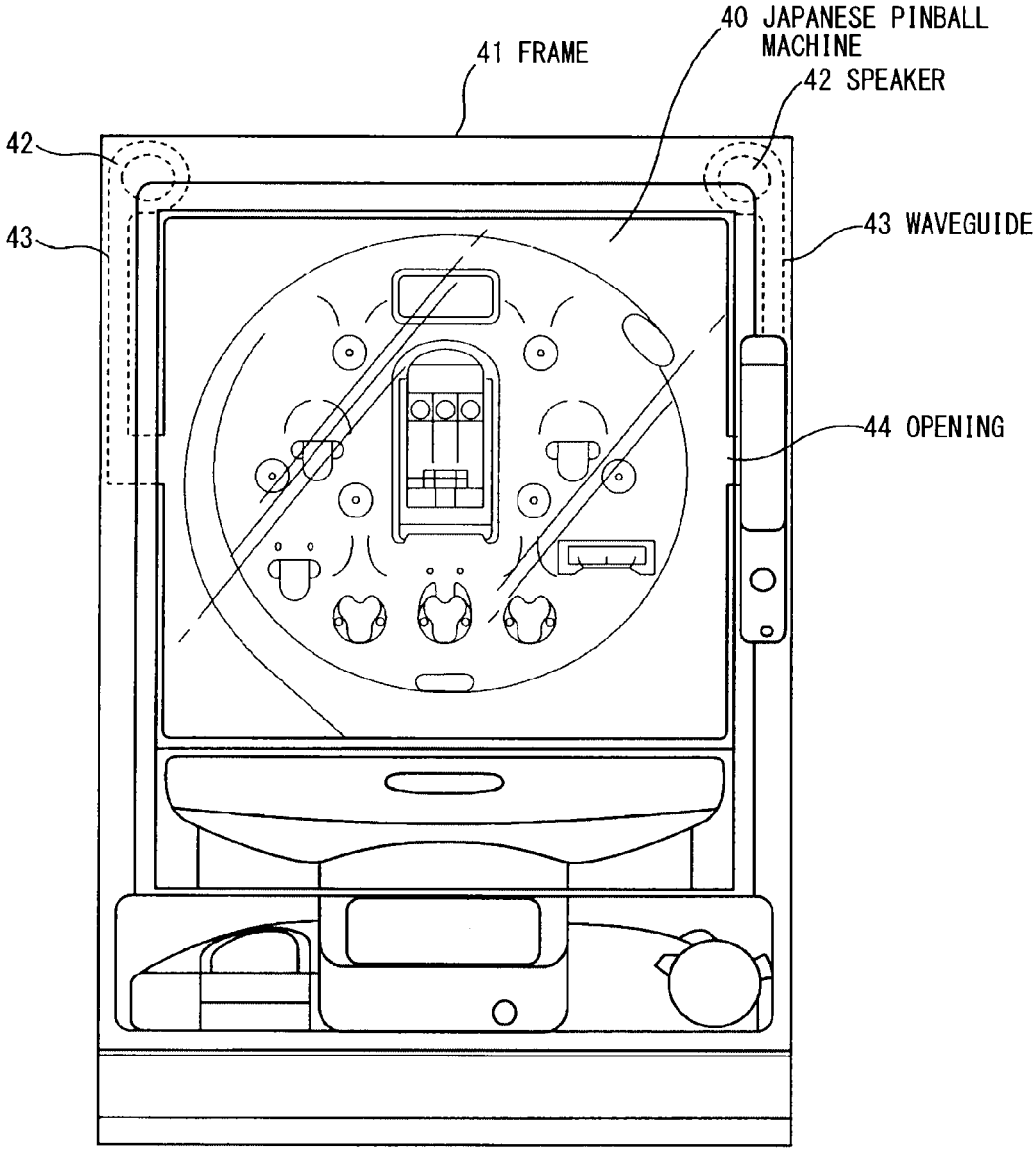

FIG. 4 represents a third embodiment when the present invention is practically used in a game device. Referring to FIG. 4, a reference numeral 40 designates a Japanese pinball machine. This type of device will be installed in a height as that player's face comes to just the center of the face of the board, and normally it has a speaker individually to play a sound as uplifting the player's mental state. However, speakers 42 cannot be installed in the height of a player's face (ears) in relation to attached space, and are attached to empty spaces such as the corners of the left, right, top and bottom. The face of the board is covered with a clear glass (not shown) put in a frame 41.

In this embodiment, a waveguide 43 is attached to a proper place such as the interior, front, back of the frame 41 of the Japanese pinball machine 40, and sound is led from the speakers 42 attached to the upper left and right corners of the Japanese pinball machine to the height of the player's face. The waveguide 43 is attached so as to cover the front openings of the speakers 42, and the other openings 44 are set to be a positional relationship that one side of the opening surface tightly adheres to the glass surface covering the surface of the Japanese pinball machine, and the opening surface of the waveguide and the glass surface are almost perpendicular to each other. And a sound source is generated in this position, and the player facing the face of the board is brought to listen to a sound coming from the front at just in the height of the ears. Therefore, extremely natural sound feeling can be obtained.

Note that, in game machines such as the Japanese pinball machine 40, there is one in that the frame 41 with a put-in glass can be opened and closed as a door for maintenance check. In the case, by attaching the speakers 42 and the waveguides 43 to the main body side of the Japanese pinball machine, a door may be positioned so that when the door frame 41 is closed, one side of the opening 44 just abuts the glass surface.

Further, by attaching only the speakers 42 to the main body side of the Japanese pinball machine, it may be positioned so that when the door frame 41 is closed, the opening of the waveguide on the speaker side covers the speaker opening.

The speaker system according to the present invention does not need depth; it does not make a user conscious the presence of a speaker. Therefore, not only limited to the aforementioned embodiments, by attaching it for example to a wall having a plane, a painting and an advertising board so that an opening surface is perpendicular, it makes possible that a BGM, a commentary, a commercial or the like can be naturally heard from the position.

Furthermore, the waveguide is unnecessary to be a straight tube, and it can be curvilinear according to the form of an attached part.

The invention claimed is:

1. A speaker system, comprising:

a cabinet;

a speaker attachable to the cabinet;

a waveguide attachable to a front opening of said speaker at a speaker end; and a linear side formed in an opening section of said waveguide, said opening section being on an opposite end of said waveguide to said speaker end, wherein said waveguide is tightly attached to a device plane so that said linear side is contacted directly to said device plane, and a surface of said opening section is substantially perpendicular to said device plane such that sound is reflected from said device plane.

2. The speaker system according to claim 1, wherein said device plane is a front panel of a device, a window glass of an automobile, a front glass of a game device, a publication panel, a painting, or a wall.

3. The speaker system according to claim 1, wherein said waveguide also functions as a leg pole of a device and a hanging pole.

4. The speaker system according to claim 3, wherein said cabinet also functions as a base of the leg pole of the device and a base of the hanging pole.

5. A speaker system comprising:

a cabinet;

a speaker attachable to the cabinet;

a waveguide attachable to a front opening of said speaker at a speaker end; and a linear side formed in an opening section of said waveguide, said opening section being on an opposite end of said waveguide to said speaker end, wherein said waveguide is tightly attached to a device plane so that said linear side is contacted directly to said device plane, and a surface of said opening section is substantially perpendicular to said device plane, and wherein a virtual sound source is created near a position where the device plane and said linear side in the opening section of the waveguide abut.

6. The speaker system according to claim 1, wherein a thickness of the waveguide is less than or equal to one-half of a wavelength of the sound.

7. The speaker system according to claim 5, wherein a thickness of the waveguide is less than or equal to one-half of a wavelength of the sound.

8. The speaker system according to claim 1, further comprising:

an air flow resistance element that covers the opening section to reduce tube resonance of the waveguide.

9. The speaker system according to claim 5, further comprising:

an air flow resistance element that covers the opening section to reduce tube resonance of the waveguide.

* * * * *